US006109971A

United States Patent [19]

Vadlakonda

[11] Patent Number: 6,109,971

[45] **Date of Patent: *Aug. 29, 2000**

[54] HIGH-SPEED SERIAL DATA CABLE WITH IMPROVED ELECTROMAGNETIC PERFORMANCE

[75] Inventor: Prashanth Vadlakonda, San Francisco, Calif.

[73] Assignee: Adaptec, Inc., Milpitas, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/887,349

[22] Filed: Jul. 2, 1997

[51] Int. Cl.[7] ..... H01R 13/66

[52] U.S. Cl. ..... 439/620; 439/607

[58] Field of Search ..... 439/620, 607, 439/608, 609, 610

[56] References Cited

U.S. PATENT DOCUMENTS

| | | | |
|---|---|---|---|
| 5,407,366 | 4/1995 | Briones et al. | 439/620 X |
| 5,626,479 | 5/1997 | Hughes | 439/620 X |
| 5,769,666 | 6/1998 | Wu | 439/620 OR |

OTHER PUBLICATIONS

Unknown, "*P1394 Standard for a High Performance Serial Bus*", IEEE Standards Dept., P1394 Draft 8.0v3, Oct. 16, 1995, The Institute of Electrical and Electronic Engineers, Inc., New York, NY.

Unknown, "*Connector/Cable for Audio/Video Devices: 1394AV Interconnects*", Version 1.00, Oct. 27, 1996, 1394 Trade Association, Austin, TX.

*Primary Examiner*—Lincoln Donovan
*Assistant Examiner*—Daniel Wittels
*Attorney, Agent, or Firm*—Martine Penilla & Kim, LLP

[57] ABSTRACT

The present inventions provide a high-speed serial data cable assembly with improved electromagnetic performance. In one embodiment, the high-speed serial data cable assembly includes a first connector, a second connector, a cable portion, and a capacitor. The first connector includes a conductive housing and a first plurality of pins, one of the first plurality of the pins being a ground pin. The second connector includes a conductive housing and a second plurality of pins. The cable portion includes a shield, the cable portion electrically coupling the first plurality of pins to the second plurality of pins, and the shield electrically coupling the ground pin of the first connector to the conductive housing of the second connector. The capacitor electrically couples the conductive housing of the first connector to the shield, wherein the capacitor allows a current to flow from the shield to the conductive housing of the first connector when data is being transmitted through the cable portion at frequencies corresponding to the capacitor. In another embodiment of the present invention, the high-speed serial data cable assembly also includes a toroid disposed around the cable portion, such that the electromagnetic emissions of the high-speed serial data cable assembly is further reduced during the transmission of data. A method of manufacturing a high-speed serial data cable assembly with improved electromagnetic performance is further disclosed.

15 Claims, 8 Drawing Sheets

52
Camcorder
4
80
4
6
12
1394 Card
10
PC 80
82 TPB
82
82 TPA
84c
84b
84a
83
81 TPA
96
95
93
81
92
81 TPB
94
1
2
3
4
5
6

HIGH-SPEED SERIAL DATA CABLE WITH IMPROVED ELECTROMAGNETIC PERFORMANCE

BACKGROUND OF THE INVENTION

1. Field of the Invention

This invention relates generally to computer cables, and more particularly to methods and apparatus for efficiently transmitting high-speed serial data between a computer system and a peripheral.

2. Description of the Related Art

The transmission of information between electronic devices has been a concern since the development of the first computers. Speeds of transmission that might have once been considered fast some ten or even five years ago, would be considered a bottleneck by today's standards.

Historically, computers typically communicated by serial transmission. That is, one computer would send information to another computer a single bit at a time. Due to the relative slow clock speeds of the integrated circuits, the speed of serial data transmission is intrinsically limited.

In contrast, parallel data transmission allows a computer to send more than one bit of information at a single clock cycle. Parallel transmission requires a cable typically having many electric wires. Typically, a parallel cable has enough wires to transmit at least an eight bit word of information, thus requiring at least eight electric wires. For example, common interfaces on personal computers are parallel port and Small Computer Systems Interface (SCSI) ports. These and other parallel port configurations are designed to transmit from 8 to 16 or more bits of information per clock cycle. In order to transmit the information from one computer to another, a parallel port cable has over 20 conductors. Obviously, a cable having over 20 conductors becomes more cumbersome. In addition, the distance over which parallel cables are effective is quite limited due to synchronization factors between related bits in the various wires of the cable.

With recent advances in the speeds of the integrated circuits used to send and receive digital information, and because of the greater transmission distances possible with serial cables, there has be a return towards serial data transmission. Currently several standards for serial data transmission exist, such as ethernet, Localtalk and RS-422. Typically these types of serial transmission systems can transmit information up to about 10 megabits per second. More recently, the computer industry has been driven towards a higher speed serial data transmission standard, especially for communication between peripheral devices.

One drawback to higher speed serial data transmission is the requirement to keep electromagnetic emissions of the cables to a minimum. Under Federal Communications Commission (FCC) regulations, cables are limited as to the amount of electromagnetic radiation they can emit at certain frequencies. As seen in Table 1, the FCC's class B limits prohibit emissions by cables over 37 dB micro-volts per meter for frequencies at or below 540 MHz.

TABLE 1

| Frequency (MHz) | Class B Limit (dBμV/m) |
|---|---|
| $30 < f \leqq 230$ | 30 |
| $230 < f < 1000$ | 37 |

Recently, the electronics industry began development and standardization of a high-speed serial data transmission architecture. In 1995 the Institute of Electrical and Electronic Engineers (EEE) approved the standard for the new high-speed serial data transmission architecture. The standard is known as 1394–1995 IEEE Standard for a High Performance Serial Bus, incorporated herein by reference, one implementation of the standard commonly referred to as FireWire® which can be obtained from the Institute of Electrical and Electronics Engineers, Inc., 345 East 47th Street, New York, N.Y. 10017. The purpose of the 1394 standard is to provide a high-speed low cost serial bus for use as a peripheral bus or a parallel back-plane bus.

One of the advantages of the 1394 standard is the ability to transmit data over a cable medium at variable speeds, including very high speeds. Transceiver chip sets for the 1394 standard are now running at speeds of up to 400 Mbps, and many companies anticipate reaching speeds of up to 1 Gbps. However, the basic clocking frequency of the 1394 standard is 24.576 MHz, and data is transmitted in multiples of 24.576 MHz.

Referring initially to FIG. 1*a*, a typical 1394 cable is described. A personal computer 10 contains a 1394 peripheral card 12. Transceiver chips (not shown) in the 1394 peripheral card drives a six pin input/output port. A peripheral device 16 is typically connected to the computer 10 by a 1394 cable assembly or "cable" 20, by way of its six pin input/output port. The peripheral 16 can be almost any type of electronic device, such as a video cassette recorder, stereo system, home theater system or a camcorder, as long as it has the appropriate 1394 standard equipment to support communication with the computer 10. Additionally, peripheral devices can communicate with each other via the 1394 protocols.

Referring to FIG. 1*b*, the 1394 cable 20 has two connectors 21 and 22, and a cable portion 23. As seen in FIG. 1*c*, each connector 21 and 22 has six pins. The designation of the pins are shown in Table 2.

TABLE 2

| Pin | Signal Name | Comment |
|---|---|---|
| 1 | VP | Cable Power |
| 2 | VG | Cable Ground |
| 3 | TPB* | Strobe on receive, data on transmit |
| 4 | TPB | (differential pair) |
| 5 | TPA* | Data on receive, strobe on transmit |
| 6 | TPA | (differential pair) |

Each connector 21 and 22 has a power pin 21(1) and 22(1), respectively, a ground pin 21(2) and 22(2), respectively, and two pairs of signal pins 21(3)–(6), and 22(3)–(6), respectively. The power pins 21(1) and 22(1) are coupled together by a conductor (i.e., an insulated wire) 31. The ground pins 21(2) and 22(2) are coupled together by conductor 32. Each pair of single pins correspond to a single twisted wire pair of conductors. Pins 3 and 4 of the connectors 21(3)–(4), and 22(3)–(4) constitute twisted wire pair B of the respective connectors 21 TPB and 22 TPB. Pins 5 and 6 of the connectors 21(5)–(6) and 22(5)–(6) constitute twisted wire pair A of the respective connectors 21 TPA and 22 TPA. Each twisted pair carries a single differential signal.

The nature of the 1394 protocol allows devices to be chained together. The 1394 protocol requires two-way communication between devices in a branch-leaf chain. Cable 20 used to connect the devices contain two twisted wire pairs to allow two-way communication. One twisted pair carries the data signal and the other twisted pair carries a strobe signal. The designation of which twisted pair is to carry the data or the strobe is dependent upon which device is sending or receiving the data. For example, using the configuration depicted in FIGS. 1*a*–1*c*, when computer 10 is transmitting it sends data out on its twisted pair B and a strobe on its twisted pair A. If cable 20, depicted in FIGS. 1*b*–*c*, is used to connect computer 10 and peripheral 16, computer 10 would be sending data on twisted pair 21 TPB, and a strobe on twisted pair 21 TPA. When computer 10 is receiving information, it receives data on twisted pair A (21 TPA) and the strobe on twisted pair B (21 TPB). The same transmission and reception scheme is true for peripheral 16, but in relation to the twisted pairs of its connector 22.

If computer 10 is transmitting data on the computer's twisted pair B (22 TPB), the peripheral should be receiving data on its twisted pair A (22 TPA). Thus, the twisted wire pairs are crossed in the cable. Again, the wiring diagram of the cable is depicted in FIG. 1*c*. Using the example of a 1394 standard configuration depicted in FIG. 1*a*, pins 3 and 4 of the first connector 21(3) and 21(4) represent twisted wire pair B of the computer (22 TPB), or for the purposes of this example, the data output of computer 10. Pins 3 and 4 21(3) and 21(4) are connected to the twisted pair wires 33 and 34, respectively. The twisted pair wires 33 and 34 are then connected to pins 5 and 6 of the second connector 22(5) and 22(6). Pins 5 and 6 of the second connector 22 represent twisted wire pair A (22 TPA) with respect to the peripheral 16, or the data receive of the peripheral 16.

Similarly, the strobe output of computer 10 is represented by pins 5 and 6 of the first connector 21(5) and 21(6), representing the computer's twisted wire pair A (21 TPA), is carried on the twisted wires 35 and 36, respectively. And, the twisted wires 35 and 36 are connected to pins 3 and 4 of the peripheral 16 to become its strobe input, or twisted wire B (22 TPB). As can be seen, when the peripheral 16 is transmitting data, the computer receives the data and the strobe on its appropriate twisted wire pairs.

Importantly, cable portion 23 usually has inner shields 24*a* and 24*b* surrounding each twisted wire pairs 33–34 and 35–36. The inner shields 24*a* and 24*b* are typically electrically coupled together by a galvanic connection 38 and to the ground wire 32. The cable portion 23 also has an outer shield 24*c*. Outer shield 24*c* is typically coupled to the housings of the two connectors by a low impedance coupling 39. For standard 6-to-6 connectors, this scheme of shielding has been adequate to meet FCC standards at data transmission rates of 200 Mbps, mainly due to the fact that the cable 23 carries a ground wire to which it can ground its inner shields 24*a* and 24*b*, and the outer shield 24*c* is independently grounded through the connector housings.

Cable 20 carries a power 31 and a ground wire 32 because the 1394 standard allows for devices to draw power from other devices. This is a useful feature of the 1394 standard, however not all devices require power from cable 20. Thus, some companies have utilized cables that do not carry power. For example, the Sony Corporation has utilized 4-to-4 pin connectors and cables for its camcorder products, as seen in FIG. 2*a*. The 4-to-4 cable 60 couples two camcorders 50 and 52. Each camcorder 50 and 52 has its own power supply, thus, no longer requiring the power and ground wires. By reducing the number of pins and conductors required in the cable, the size of the connectors have been reduced to about a third of the size of the standard 6-to-6 pin cable connector. For applications such as camcorders, the reduction in size of the connectors is a definite advantage.

A potential problem with the 4-to-4 pin cable is the electromagnetic performance of the cable. Referring to FIG. 2*b*, a 4-to-4 pin cable 60 is depicted. Cable 60 has two connectors 61 and 62, and a cable portion 63. Referring to FIG. 2*c*, the connectors 61 and 62 have a total of four pins 61(1)–(4) and 62(1)–(4), respectively. Corresponding to the configuration of the signal pins of the standard 6-to-6 cable, pins 1 and 2 61(1)–(2) of the first connector 61 are coupled to pins 3 and 4 62(3)–(4) of the second connector 62 by conductors 71 and 72, respectively. Again, following the 1394 protocol, the twisted pair A of one connector is connected to the twisted pair B of the other connector. Pins 3 and 4 61(3)–(4) of the first connector 61 are coupled to pins 1 and 2 62(1)–(2) of the second connector 62. Thus, pins 1 and 2 of the connectors 61 and 62 represent twisted pair B (61 TPB and 62 TPB), and pins 3 and 4 represent twisted pair A (61 TPA and 62 TPA), of the respective connectors 61 and 62. The cable portion 63 may or may not have inner shields 64*a* and 64*b*, but typically has an outer shield 64*c*.

Since there are no ground or power pins on connectors 61 and 62, the outer and inner shields of the 64*a*–*c* are not coupled to a ground, i.e., they are "floating". Because the shields 64*a*–*c* are not grounded, the cable 60 can exhibit high levels of electromagnetic radiation when carrying high frequency data. That is, when data is being transmitted through the cable at high-speeds, it is possible that the cable can emit electromagnetic radiation in excess of the FCC limits.

Another problem with the four pin configuration for 1394 standard applications is the inability to communicate with devices with the standard six pin configuration. Referring to FIG. 3*a*, a user may wish to connect a computer 10 having a six pin connection to a camcorder 52 having a four pin connection. One solution has been to create a 6-to-4 cable 80 by mating a six pin connector with a four pin connector using a four wire cable. The 6-to-4 cable configuration is referred to as a AV 1394 cable.

Referring to FIGS. 3*a* and 3*b*, a typical 6-to-4 pin cable 80 of the AV 1394 type cable is depicted. The cable 80 has a standard 6 pin connector 81 and a four pin connector 82. The signal pins 81(3)–(6) and 82(1)–(4) of the connectors are connected in accordance with Table 3, below, through conductors 93–96, respectively.

TABLE 3

| Pin # of 6 Pin Connector | Description | Pin # of 4 Pin Connector | Description |
|---|---|---|---|
| 1 | VP | — | |
| 2 | VG | — | |
| 3 | TPB* | 3 | TPA* |
| 4 | TPB | 4 | TPA |
| 5 | TPA* | 1 | TPB* |
| 6 | TPA | 2 | TPB |

The cable 80 may or may not have inner shields 84*a* and 84*b* disposed around the twisted pair wires. Typically the cable 80 will have an outer shield 84*c*. Outer shield 84*c* is typically coupled to the ground pin 81(2) of the six pin connector 81 by a conductor 92.

Again, the 6-to-4 cable 80 can fail to provide adequate electromagnetic shielding during the transmission of data. While attempting to solve the problem of connecting a six and a four pin connector, the 6-to-4 pin cable 80 was not designed to reduce electromagnetic emissions. The connection of outer shield 84*c* to ground pin 81(2) does allow for a return path for direct currents, but is typically inadequate to shunt alternating currents generated within the shields 84*a–c* during the transmission of high-speed serial data.

Table 4 shows the electromagnetic output of a 6-to-4 cable operating at various high clock rates, in multiples of the basic clocking rate of 24.576 MHz, using a peak detector.

TABLE 4

| f (MHz) | Electromagnetic Emission (dBμV/m) | FCC Class B Limit (dBμV/m) | Emission - Class B Limit | Table Degrees | Antenna Height (m) | Polarization |
|---|---|---|---|---|---|---|
| 196.608 | 35.8 | 30.0 | 5.8 | 90 | 1.5 | Vertical |
| 196.600 | 33.5 | 30.0 | 3.5 | 90 | 2.0 | Horizontal |
| 245.760 | 42.3 | 37.0 | 5.3 | 0 | 2.0 | Vertical |
| 245.75 | 37.9 | 37.0 | 0.9 | 90 | 2.5 | Horizontal |
| 540.660 | 30.0 | 37.0 | −7.0 | 90 | 1.5 | Vertical |
| 540.660 | 39.5 | 37.0 | 2.5 | 90 | 1.0 | Horizontal |

As can be seen, the performance of the 6-to-4 cable does not meet the specifications provided by the FCC. Thus, current 6-to-4, and possibly 4-to-4 and 6-to-6 1394 cables can be prone to emit overly high amounts of electromagnetic radiation during the transmission of high-speed serial data.

Some prior art cables used for high-speed serial data transmission have failed to meet the standards for electromagnetic transmission set by the FCC. Thus, what is desired are improved methods and cables for the efficient transmission of high-speed serial data while minimizing electromagnetic emissions.

SUMMARY OF THE INVENTION

The present invention provides a high-speed serial data cable with improved electromagnetic performance. In one embodiment, a high-speed serial data cable with improved electromagnetic performance includes a pair of connectors, a shielded cable portion, and a capacitor coupling the shield of the cable portion to a housing of one of the connectors. The capacitor allows a current to flow from the shield to the connector housing, thereby reducing the electromagnetic emissions of the high-speed serial data cable during the transmission of data.

In another embodiment, the high-speed serial data cable includes a first connector, a second connector, a cable portion, and a capacitor. The first connector includes a housing and a first set of pins, one of which is a ground pin. The second connector includes a housing and a second set of pins. The cable portion includes a shield and a number of wires coupling the first set of pins to the second set of pins. The shield of the cable electrically couples the ground pin of the first connector to the housing of the second connector. The capacitor electrically couples the housing of the connector to the shield, such that it allows a current to flow from the shield to the housing of the first connector when data is being transmitted through the cable portion at certain frequencies determined by the capacitive value of the capacitor.

In another embodiment of the present invention, the high-speed serial data cable also includes a toroid placed around the cable portion. The toroid further reduces the electromagnetic emissions of the high-speed serial data cable during the transmission of data.

In a further embodiment of the present invention, the first set of pins also includes a power pin, a first pair of signal pins, and a second pair of signal pins. The second set of pins includes a third pair of signal pins, and a fourth pair of signal pins, such that wires of the cable portion electrically couple the first pair of signal pins to the third pair of signal pins, and electrically couples the second pair of signal pins to the fourth pair of signal pins. The power pin remains unconnected.

In a still further embodiment of the present invention, the high-speed serial data cable includes two capacitors which couple the shield to the housing of the first connector in parallel, such that the capacitors allow a current to flow from the shield to the housing of the first connector when data is being transmitted through the cable portion at frequencies corresponding to the first capacitor and at frequencies corresponding to the second capacitor, thereby even further reducing the emission of electromagnetic energy from the high-speed serial data cable.

Therefore, the present invention advantageously provides a serial data cable assembly capable of supporting high-speed data transmissions without producing excessive electromagnetic radiation that might cause interference with other nearby electronic devices. These and other advantages of the present invention will become apparent to those skilled in the art upon a study of the specification and drawings describing the present invention.

BRIEF DESCRIPTION OF THE DRAWINGS

The invention, together with further aspects and advantages thereof, may best be understood by reference to the following description taken in conjunction with the accompanying drawings in which.

DETAILED DESCRIPTION OF THE PREFERRED EMBODIMENTS

The present invention will now be described in detail with reference to exemplary preferred embodiments as illustrated in the accompanying drawings. In the following description, numerous specific details are set forth in order to provide a thorough understanding of the present invention. It will be apparent, however, to one skilled in the art, that the present invention can be practiced without some or all of these specific details. In other instances, well known process steps have not been described in detail in order to not unnecessarily obscure the present invention.

Figure 1A:
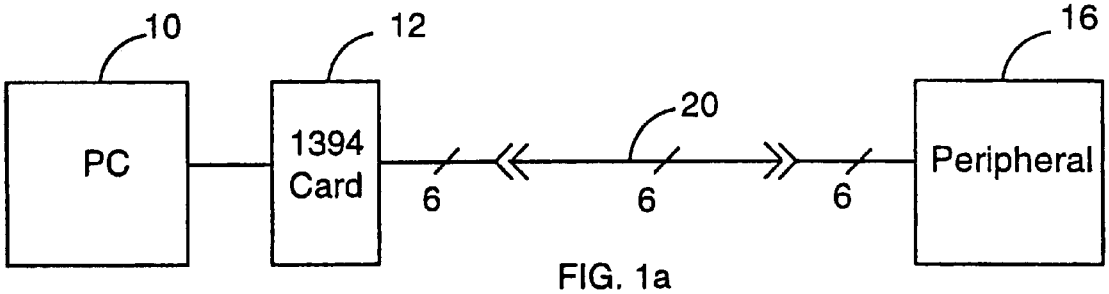
FIG. 1a (Prior Art)
FIG. 1*a* is a block diagram of a prior art 1394 standard connection.
Figure 2A:
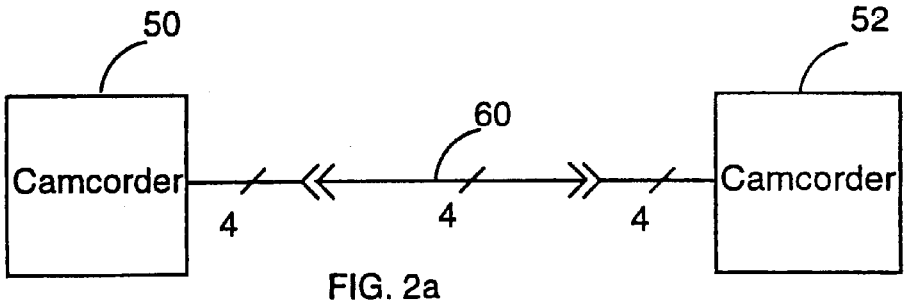
FIG. 2a (Prior Art)
FIG. 2*a* is a block diagram of a prior art 4-to-4 1394 standard connection.
Figure 1B:
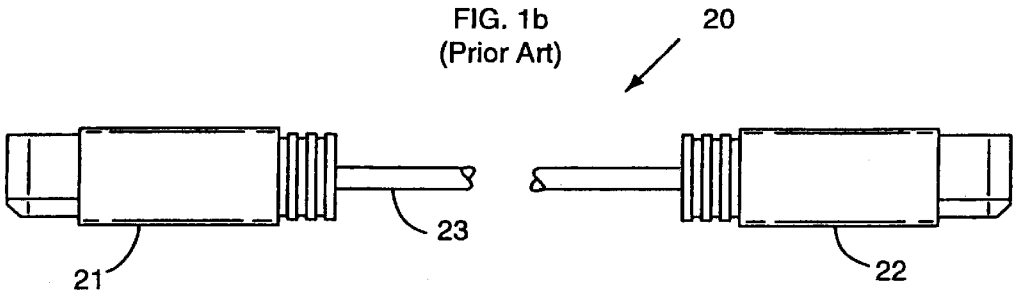
FIG. 1b (Prior Art)
FIG. 1*b* is an illustration of a prior art 6-to-6 1394 standard cable.
Figure 1C:
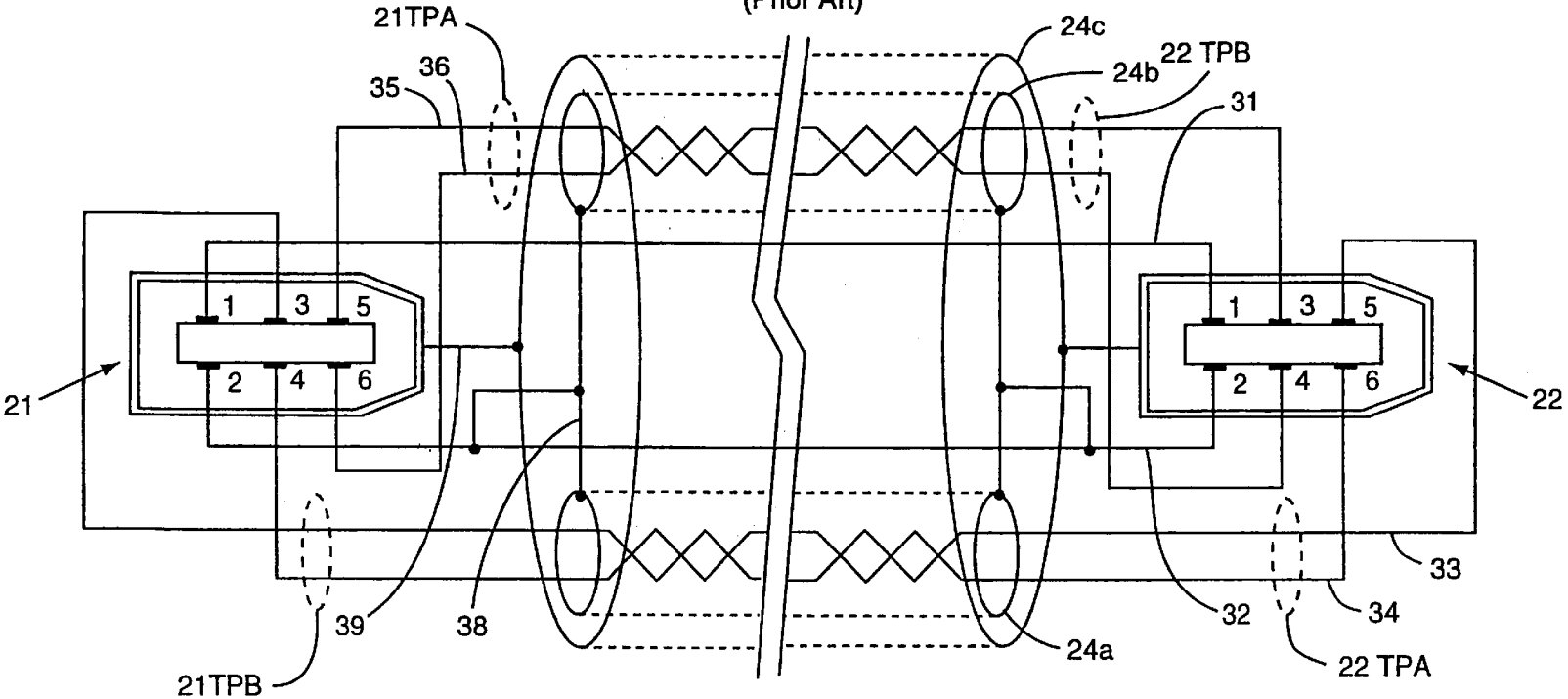
FIG. 1c (Prior Art)
FIG. 1*c* is a wiring diagram of the prior art 6-to-6 1394 standard cable of FIG. 1*b;*
Figure 2B:
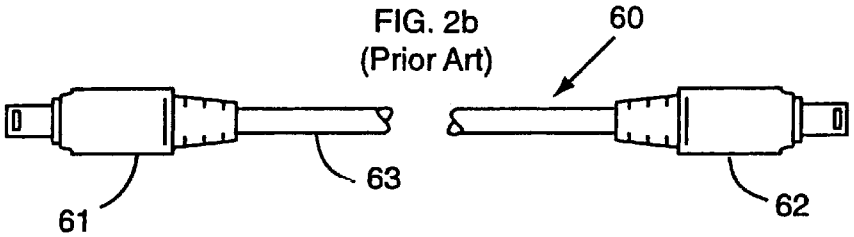
FIG. 2b (Prior Art)
FIG. 2*b* is an illustration of a prior art 4-to-4 1394 standard cable.
Figure 2C:
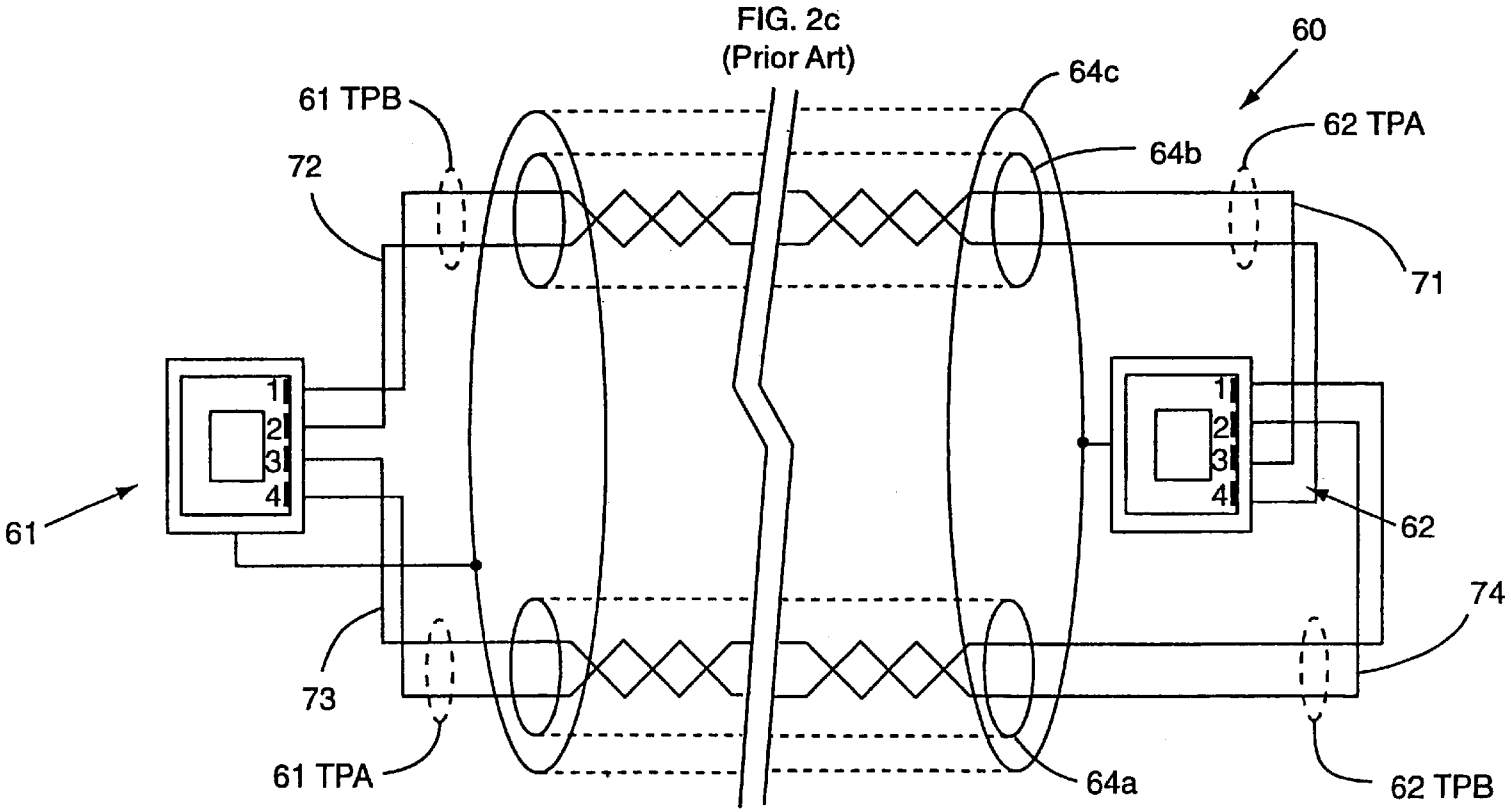
FIG. 2c (Prior Art)
FIG. 2*c* is a wiring diagram of the prior art 4-to-4 1394 standard cable of FIG. 2*b;*
Figures 3A, 3B:
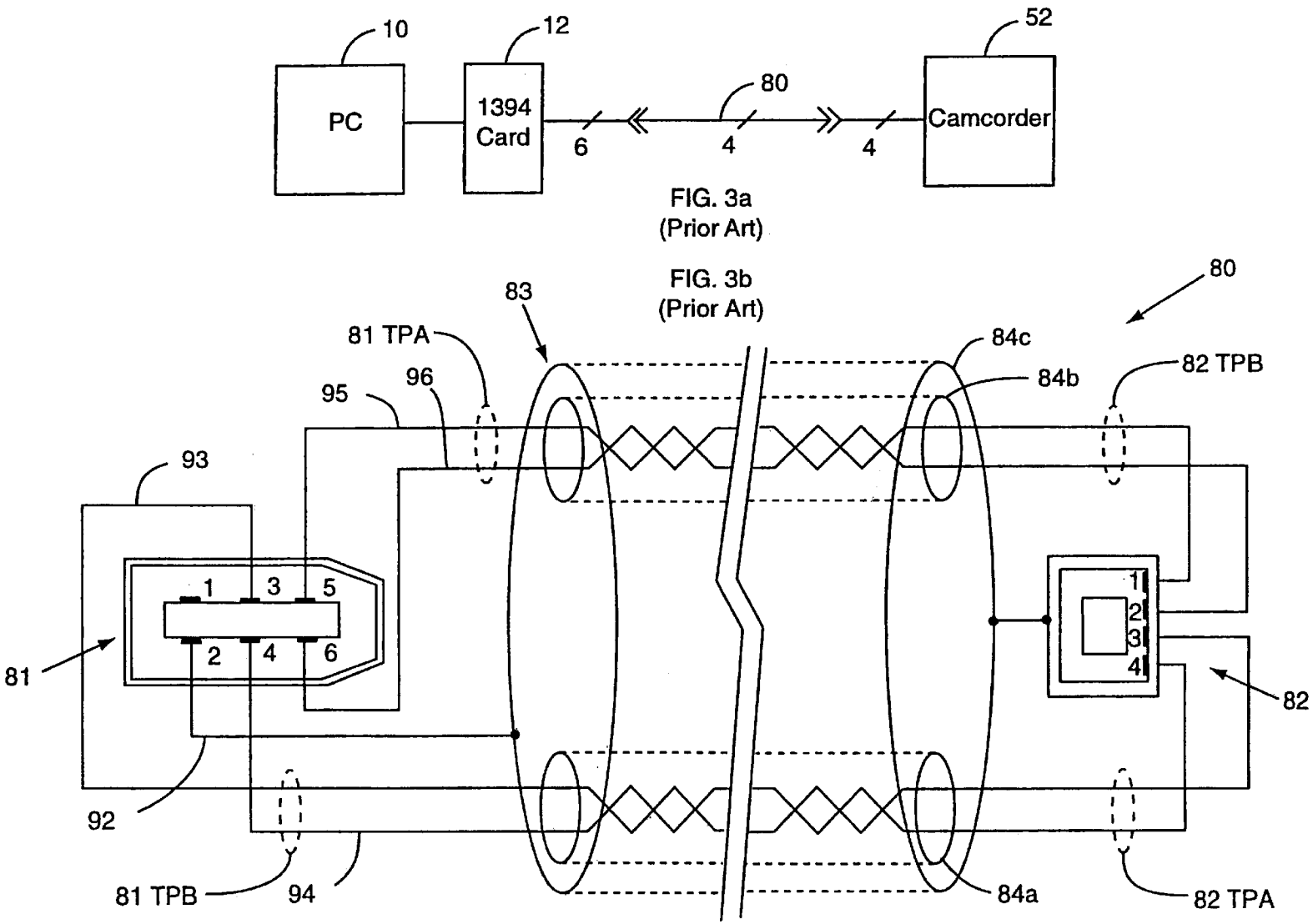
FIG. 3a (Prior Art)
FIG. 3b (Prior Art)
FIG. 3*a* is a block diagram of a prior art 6-to-4 AV 1394 standard connection.
FIG. 3*b* is a wiring diagram of a prior art 6-to-4 AV 1394 standard cable.
Figure 4A:
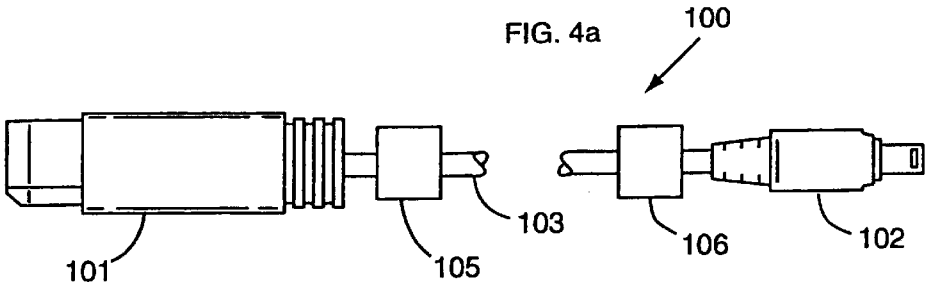
FIG. 4*a* is an illustration of one embodiment of a 6-to-4 high speed serial data cable assembly in accordance with the present inventions.
Figure 4B:
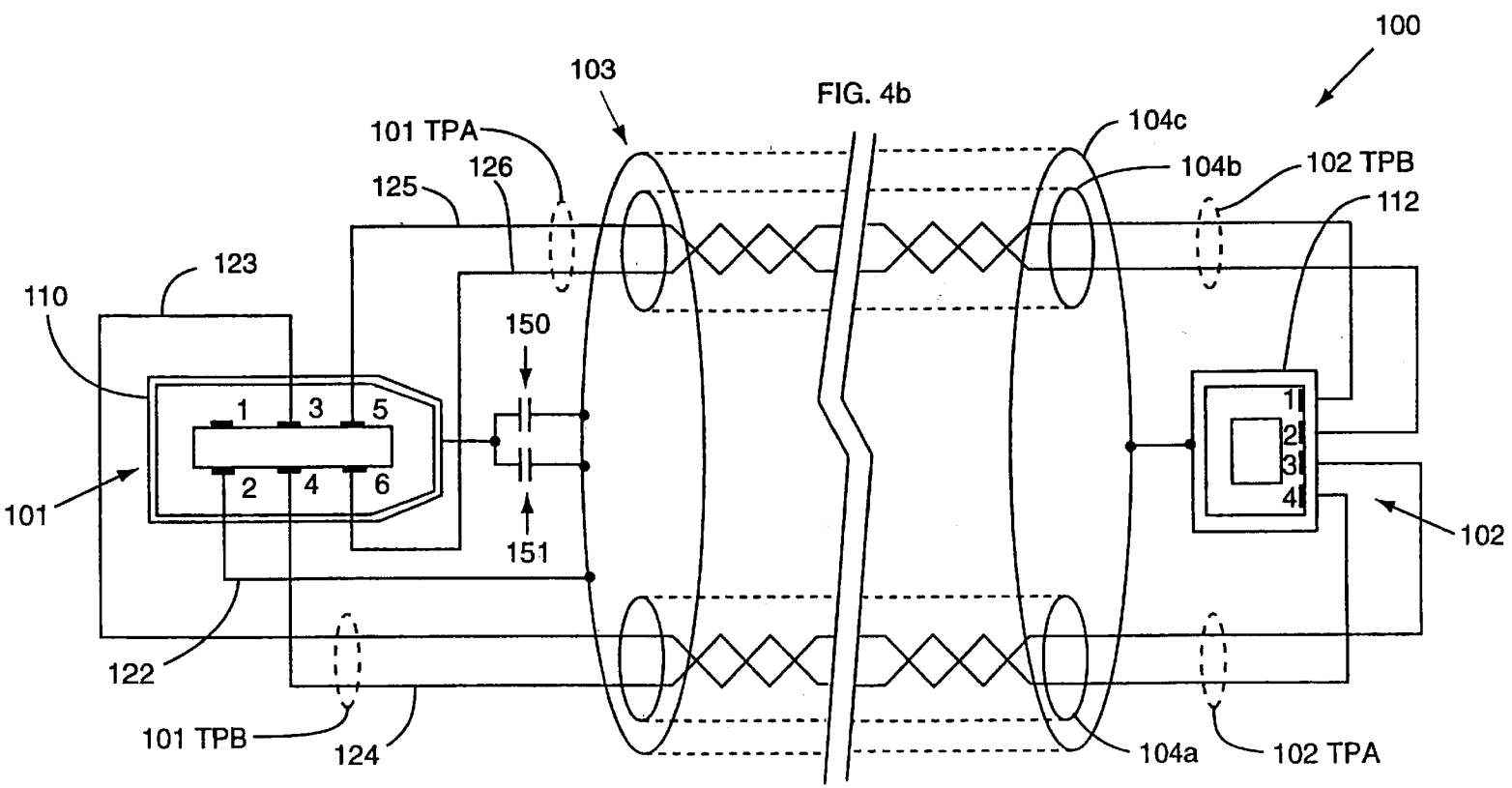
FIG. 4*b* is a wiring diagram of the cable assembly of FIG. 4*a;*

The present invention provides methods of improving the electromagnetic performance of a high-speed serial data cable, high-speed serial cables with improved electromagnetic performance, and methods for making same. In FIGS. 4*a–b*, one embodiment of the present invention is a 6-to-4 high-speed serial cable assembly 100. The high-speed serial cable assembly 100 can conform to the IEEE 1394–1995 standard, or can be any type of high-speed serial data transmission cable assembly. In the illustrated embodiment, cable assembly 100 is for use in connecting electronic devices utilizing the IEEE 1394–1995 standard for communications between electronic devices.

Cable assembly 100, in the illustrated embodiment, has a six pin connector 101, a four pin connector 102, and a cable portion 103. In a preferred embodiment, cable assembly 100 can additionally have two toroids 105 and 106 disposed around the cable portion 103.

In one embodiment, the six pin connector 101 has a power pin 101(1), a ground pin 101(2), four signal pins 101(3)–(6), and a housing 110. Housing 110, typically, is a conductive shield formed around pins 101(l)–(6). Plastic molding, in a preferred embodiment, can be formed around housing 110 to insulate connector 101. The four pin connector 102 has four signal pins 102(1)–(4). In the illustrated embodiment, the signal pins of the six pin connector 101(3)–(6) are connected to the signal pins of the four pin connector 102(1)–(4), as set forth in Table 3, by way of conductors 123–126. Additionally, the six pin connector 101 has a plurality of capacitors 150 and 151.

Cable portion 103 preferably has inner shields 104*a* and 104*b*, and an outer shield 104*c*. The inner shields 104*a* and 104*b* can be coupled to the outer shield 104*c*, or can be isolated from the outer shield 104*c*, depending on which configuration provides the best electromagnetic performance for a given application.

A feature of the present invention is the coupling of the outer shield 104*c* to different elements (e.g., wires, shields, housings, capacitors) of cable assembly 100. In the illustrated embodiment, outer shield 104*c* is electrically coupled to the housing of the second connector 112. Outer shield 104*c* is also connected to the ground pin of the first connector 101(2). The coupling of the outer shield 104*c* to the housing of the second connector 112 allows for a return path for direct currents, To ensure that the high-speed serial data cable assembly 100 performs better at frequencies specified in the 1394 standard, the outer shield 104*c* is coupled to the housing of the first connector 110 by one or more capacitors 150 and 151. It is believed that the common mode voltages generated in the outer shield 104*c* are constrained by the impedance of the cable assembly 100 and the transmission frequency. By coupling the outer shield 104*c* with capacitors 150 and 151, the impedance of the outer shield is believed to be decreased, which would enhance the flow of alternating current from the outer shield 104*c* to the housing 110 at certain frequencies. By facilitating the flow of the current built up in the outer shield 104*c*, the common mode voltage can be reduced.

The improvement in the electromagnetic performance of the outer shield 104*c* can also be similarly applied to inner shields 104*a* and 104*b*. That is, in another embodiment, the inner shields 104*a* and 104*b* are coupled to the housing of the six pin connector 110 by capacitors 150 and 151.

TABLE 5

| f (MHz) | Electromagnetic Emission (dBμV/m) | FCC Class B Limit (dBμV/m) | Emission - Class B Limit | Table Degrees | Antenna Height (m) | Polarization |
|---|---|---|---|---|---|---|
| 196.600 | 19.2 | 30.0 | −10.8 | 180 | 1.5 | Vertical |
| 196.600 | 28.7 | 30.0 | −1.3 | 180 | 3.0 | Horizontal |
| 245.783 | 25.6 | 37.0 | −11.4 | 0 | 2.5 | Vertical |
| 245.768 | 25.6 | 37.0 | −11.4 | 270 | 3.0 | Horizontal |
| 540.600 | 29.8 | 37.0 | −7.2 | 180 | 3.0 | Vertical |
| 540.600 | 33.9 | 37.0 | −3.2 | 200 | 1.5 | Horizontal |

Figure 5:
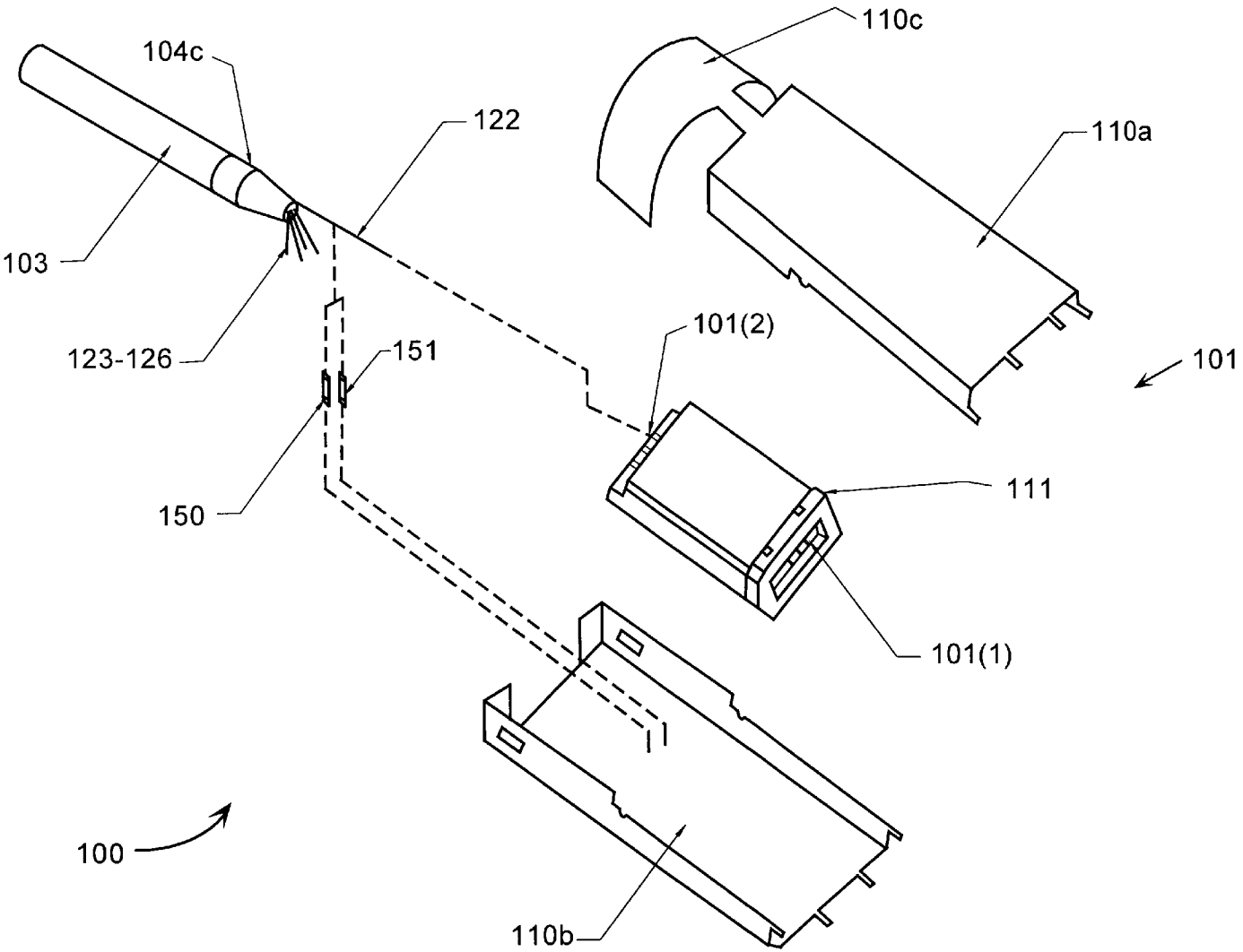
FIG. 5 is a disassembled view of the 6 pin connector end of the high-speed serial data cable assembly of FIG. 4*b;*

Referring to FIG. 5, a disassembled view of a portion of cable assembly 100 connected to a six pin connector 101 is depicted in accordance with one embodiment of the present inventions. Housing 110 includes an upper housing member 110*a*, a lower housing member 110*b*, where an upper housing member 110*a* includes a strain relief portion 110*c*. Within the housing 110 is a plastic connector body 111. Typically housing members 110*a–c* are conductive, and, in a preferred embodiment, plastic molding can be formed around the housing 110 to insulate the connector 101.

Pins 101(1)–(6) are supported by the plastic connector body 111. Cable conductors 123–126 are connected to the signal pins 101(3)–(6). Conductor 122 electrically connects outer shield 104*c* to the ground pin 101(2) of the connector 101. In one embodiment, conductors 122–126 are insulated wires. Capacitors 150 and 151 are electrically connected in parallel to the conductor 122 and the lower housing member 110*b*.

Due to the limited space between cable portion 103 and the housing of the first connector 110, in the illustrated embodiment, the capacitors 150 and 151 are preferably of small size. In one embodiment, the capacitors 150 and 151 are 50 volt NPO type capacitors in a 1206 package. Such capacitors are available from AVX/Kyocera, Johanson, Kemet, and other capacitor manufacturers. The 1206 type package is suitable for use in one embodiment of the present inventions because of its small size. However, any similarly sized capacitors are applicable to the present invention.

The proper values of capacitors 150 and 151 are important to minimize electromagnetic radiation for a particular cable application. In the illustrated embodiment, 6-to-4 cable assembly 100 is used for 1394 standard applications. Since the 1394 standard operates at multiples of 24.576 MHz, the values of capacitors 150 and 151 should be chosen to cover the range of frequency values likely to be used, or for which radiated emissions exceed the FCC limits. In the instant embodiment, a frequency range between about 196 MHz to 540 MHz is the frequency range. The impedance of a capacitor is a function of its capacitance and frequency. Thus, a capacitance (or capacitances) can be chosen that will act appropriately at the desired frequency or frequencies. In the illustrated embodiment, a capacitor having low impedance at the stated frequency range is desired to facilitate the conduction of current at those frequencies.

Figure 6:
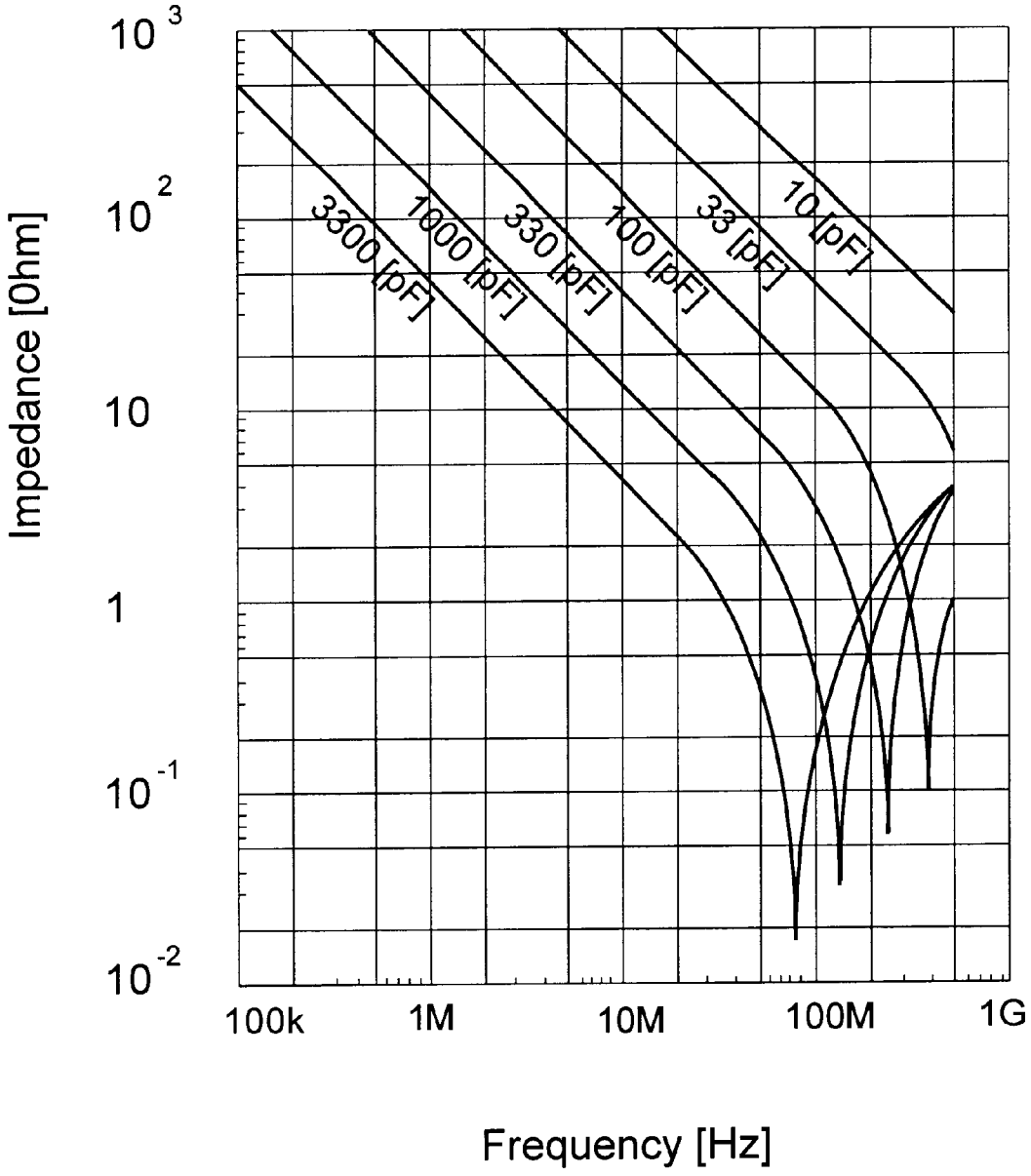
FIG. 6 is an impedance-frequency chart for capacitance values between 10 picofarads to 3300 picofarads.

Referring to FIG. 6, an impedance-frequency chart is shown for a range of capacitor values. Since the lower end of the desired frequency spectrum is about 100 MHz a capacitance value between 330 picofarads and 1000 picofarads is desired. A value of 470 picofarads is selected as the value for capacitor 150, in the illustrated embodiment. In another embodiment, if the cable is used at only one frequency, or the radiated emissions are over the FCC limits at approximately one frequency, then only one capacitor is required, although multiple capacitors can also be used.

Figure 7:
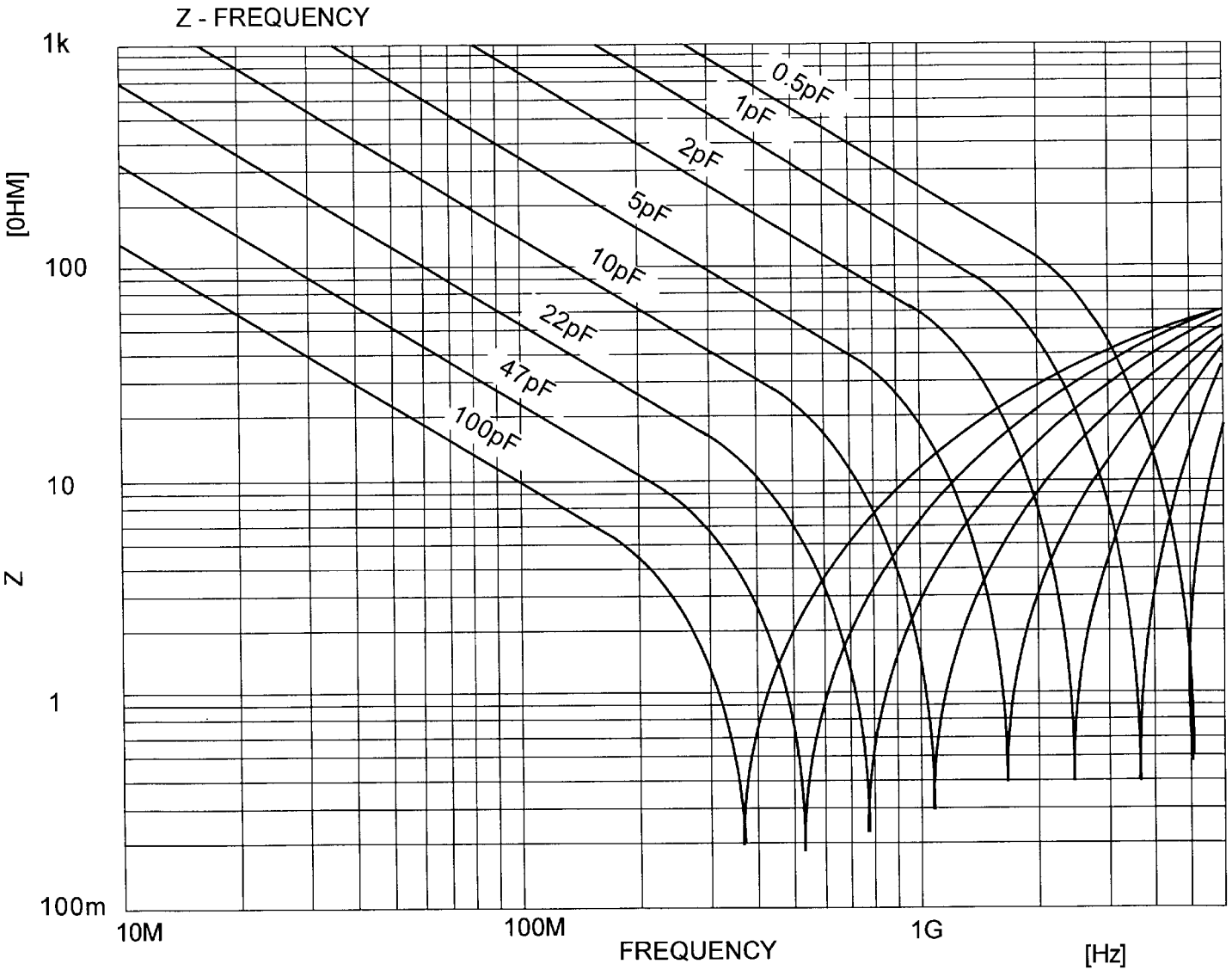
FIG. 7 is an impedance-frequency chart for capacitance values between 0.5 picofarads to 100 picofarads.

In the illustrated embodiment, cable assembly 100 is used for a variety of frequencies, including the frequency range contemplated by the 1394 standard, thus, more than one capacitor is typically preferred. After arriving at a first capacitance, the second capacitance should be chosen to cover a remaining portion of the frequency range. Typically, the second capacitance should be from about ten times to about one hundred times the capacitance of the first capacitance to cover a sufficient frequency range. In the instant example, a capacitance effective at about 500 MHz can be selected. Referring to FIG. 7, an impedance-frequency chart is shown for greater values of capacitance. In the illustrated embodiment, 47 picofarads is chosen as the value for capacitor 151. In another embodiment, more than two capacitors can be used to ensure effective coverage of a frequency range.

In addition to the use of capacitors in the cables, another novel feature of the present inventions is the addition of toroids to help improve the electromagnetic performance of the cable assembly 100. A toroid is typically a ferrous material shaped in a substantially circular shape. A single toroid, or a plurality of toroids can be disposed anywhere about the cable portion. In the illustrated embodiment, two toroids 105 and 106 are depicted as being disposed around the cable portion 103 near the connectors 101 and 102. It is believed, toroids 105 and 106 add inductance to the cable assembly 100, thereby further fine tuning the impedance of the outer shield 104*c* to help shunt off any alternating currents generated within the outer shield 104*c*. Any suitable type of toroid can be used in accordance with the present inventions. In one embodiment, toroids 105 and 106 can be a type 43 toroid, which can be obtained from Steward.

As can be appreciated, the capacitances of capacitors 150 and 151 can have almost any value, dependent upon the operating frequency of the cable assembly 100. In a range of embodiments, capacitors 150 and/or 151 range from 10 to 4700 picofarads, which covers the frequencies between 20 MHz to 1 GHz, thereby covering the transmission frequencies of most serial data transmission protocols.

As noted above, any type of capacitors can be utilized in accordance with the present inventions. Surface mount capacitors are preferred due to their size. By ways of example, surface mount capacitors of types 0403 (EIA)/R09 (JDI), 0504/R11, 0805/R15, 1206/R18, 1210/S41, 1808/R29, 1812/S43 and 2221/S47, and similar type capacitors can be utilized. Similarly, other types of capacitors can be substituted for surface mount capacitors, as long as the sizes of the capacitors are suitable for mounting within the housing of the connectors. By ways of example, axial, radial and other various types of capacitors can be used, as long as the lead inductance of the capacitors do not interfere with the operation of the cable.

In one embodiment that adheres to the 1394 standard, cable portion 103 has a length of approximately 4.5 meters or less. Signal conductors 123–126 are 28 AWG (7×36)/ϕ1.0 insulation, twist 40/meter wires. The signal pairs 123–124 and 125–126 are matched for skew and other factors. Inner shields 104*a* and 104*b* are 60–65% braided copper, over spiral-wrap metallized polyester tape, with the metal on the outside. The inner shields are typically in contact with each other but isolated from outer shield 104*c*. Outer shield 104*c* is a 90–95% braided copper wire over spiral-wrap metallized polyester tape, with the metal on the outside. Cable portion 103 also includes an insulating outer jacket having a thickness of about 0.70 to 0.90 mils. Such a cable portion 103 can be obtained from Space Shuttle of Taiwan.

By way of examples, connectors 101 and 102 can be composed of standard materials. Conductive housings 110 and 112 can be tin plated stainless steel or aluminum, or composed of other suitable types of material. Pins 101(1)–(6) and 102(1)–(4) can be tin plated solder tail type pins, which can be obtained from DDK. An outer plastic molding can encase connectors 101 and 102. The plastic molding can be formed from any suitable type of plastic. Components for connectors 101 and 102, in another embodiment, can be obtained by vendors such as SMK of Japan, not including capacitors 150 or 151.

As can be appreciated, the present inventions can be applied to any type of high-speed data transmission cable. That is, the present inventions are not limited to the IEEE 1394–1995 protocol. For example, the present inventions can be applied to high-speed data transmission cables used in SCSI, ethernet, Localtalk, RS-232, RS-422, Integrated Services Digital Network (ISDN), Asynchronous Transfer Mode (ATM), and other types of local area and wide area networks and the appropriate cables used in those networks, without limitation.

While this invention has been described in terms of several preferred embodiments, there are alterations, permutations, and equivalents which fall within the scope of this invention. For example, the apparatuses and methods of the present invention can be applied to other non-1394 standard cables and/or data transferring systems. It should also be noted that there are alternative ways of implementing both the method and apparatus of the present invention. It is therefore intended that the following appended claims be interpreted as including all such alterations, permutations, and equivalents as fall within the true spirit and scope of the present invention.

What is claimed is:

1. A high-speed serial data cable assembly with improved electromagnetic performance comprising:

a first connector including a conductive housing and a first plurality of pins, the first plurality of pins including a ground pin;

a second connector including a conductive housing and a second plurality of pins;

a cable portion including a shield and one or more twisted pair cables, the cable portion electrically coupling at least some of the first plurality of pins to at least some of the second plurality of pins, and the shield electrically coupling the ground pin of the first connector to the conductive housing of the second connector; and a first capacitor disposed externally between the cable portion and the first connector, the first capacitor electrically coupling the conductive housing of the first connector to the shield, wherein the first capacitor allows a current to flow from the shield to the conductive housing of the first connector when data is being transmitted through the cable portion at a first plurality of frequencies corresponding to the first capacitor, thereby reducing the emission of electromagnetic energy from the high-speed serial data cable assembly.

2. The high-speed serial data cable assembly of claim 1, further comprising a toroid disposed around the cable portion.

3. The high-speed serial data cable assembly of claim 1, wherein the first plurality of pins further includes a power pin, a first pair of signal pins, and a second pair of signal pins.

4. The high-speed serial data cable assembly of claim 3, wherein the second plurality of pins includes a third pair of signal pins, and a fourth pair of signal pins, the cable portion electrically coupling the first pair of signal pins to the third pair of signal pins, and electrically coupling the second pair of signal pins to the fourth pair of signal pins, and the power pin being unconnected.

5. The high-speed serial data cable assembly of claim 1, the high-speed serial data cable assembly further comprising a second capacitor, such that the first and the second capacitors electrically couple the shield to the conductive housing of the first connector in parallel, and the capacitors allow a current to flow from the shield to the conductive housing of the first connector when data is being transmitted through the cable portion at the first plurality of frequencies corresponding to the first capacitor, and a second plurality of frequencies corresponding to the second capacitor.

6. The high-speed serial data cable assembly of claim 5, wherein the first capacitor has a first capacitance, and the second capacitor has a second capacitance approximately ten times the capacitance of the first capacitance.

7. The high-speed serial data cable assembly of claim 5, wherein the first capacitance has a first capacitance of about forty-seven picofarads, and the second capacitance has a second capacitance of about four hundred and seventy picofarads.

8. A high-speed serial data cable assembly with improved electromagnetic performance comprising a plurality of connectors, each connector having a conductive housing, a cable portion having a shield and one or more twisted pairs of wires, the cable portion electrically coupling said plurality of high-speed serial data connectors, and a capacitor disposed externally between the cable portion and one of the plurality of high-speed serial data connectors to electrically couple the shield of the cable portion to the conductive housing of the one of the plurality of high-speed serial data connectors, wherein the capacitor allows alternating current to flow from the shield to the conductive housing, thereby reducing the electromagnetic emissions of the high-speed serial data cable assembly during the transmission of data.

9. A high-speed serial data cable assembly with improved electromagnetic performance comprising:

a first connector having four signal pins, a power pin, a ground pin, and a conductive housing;

a second connector having four signal pins, and a conductive housing;

a cable portion having a plurality of insulated signal wires electrically coupling the four signal pins of the first connector to the four signal pins of the second connector, and a shield coupled to the ground pin of the first connector, the insulated signal wires being arranged as one or more twisted pairs of wires; and a plurality of capacitors, the plurality of capacitors disposed externally between the cable portion and the first connector to electrically couple in parallel the shield to the conductive housing of the first connector, wherein when the high-speed serial data cable assembly is used for transmitting high-speed serial data at a predetermined range of frequencies causing a common mode current to be created in the shield, the plurality of capacitors shunts the common mode current from the shield to the conductive housing of the first connector, and an electromagnetic emission emitted by the shield is reduced at the predetermined frequency range of frequencies.

10. The high-speed serial data cable assembly of claim 9, wherein the shield is electrically coupled to the conductive housing of the second connector.

11. The high-speed serial data cable assembly of claim 9, further comprising a toroid disposed around the cable portion, such that the electromagnetic emissions of the high-speed serial data cable assembly is further reduced during the transmission of data.

12. The high-speed serial data cable assembly of claim 9, wherein the plurality of capacitors comprises a first and a second capacitor, the first capacitor having a first capacitance of a predetermined value, and the second capacitor having a second capacitance approximately ten times the capacitance of the first capacitance.

13. The high-speed serial data cable assembly of claim 9, wherein the plurality of capacitors comprises a first and a second capacitor, the first capacitor having a first capacitance of approximately forty-seven picofarads, and the second capacitor having a second capacitance of approximately four hundred and seventy picofarads.

14. A high-speed serial data cable assembly with improved electromagnetic performance comprising:

a first connector having four signal pins, a power pin, a ground pin, and a conductive housing;

a second connector having four signal pins, and a conductive housing;

a cable portion having a plurality of signal wires electrically coupling the four signal pins of the first connector to the four signal pins of the second connector, and a shield electrically coupling the ground pin of the first connector and the conductive housing of the second connector, the signal wires being arranged as one or more twisted pairs;

a toroid disposed around the cable portion; and a first and a second capacitor, the first capacitor having a capacitance of approximately forty-seven picofarads, the second capacitor having a capacitance of approximately four hundred and seventy picofarads, the capacitors disposed externally between the cable portion and the first connector to electrically couple in parallel the shield to the conductive housing of the first connector, wherein when the high-speed serial data cable assembly is used for transmitting high-speed serial data at a range of frequencies from about 24 megahertz to about 600 megahertz causing a common mode current to be created in the shield, the capacitors shunt the common mode current from the shield to the conductive housing of the first connector, and an electromagnetic emission emitted by the shield is reduced at approximately the range of frequencies.

15. The high-speed serial data cable assembly of claim 14, wherein the first and second capacitors are NPO type capacitors, and the toroid is a type 43 toroid.

* * * * *